US009466285B2

(12) United States Patent
Maia

(10) Patent No.: US 9,466,285 B2
(45) Date of Patent: Oct. 11, 2016

(54) SPEECH PROCESSING SYSTEM

(71) Applicant: Kabushiki Kaisha Toshiba, Minato-ku (JP)

(72) Inventor: Ranniery Maia, Cambridge (GB)

(73) Assignee: Kabushiki Kaisha Toshiba, Minato-ku (JP)

( * ) Notice: Subject to any disclaimer, the term of this patent is extended or adjusted under 35 U.S.C. 154(b) by 205 days.

(21) Appl. No.: 14/090,379

(22) Filed: Nov. 26, 2013

(65) Prior Publication Data

US 2014/0156280 A1 Jun. 5, 2014

(30) Foreign Application Priority Data

Nov. 30, 2012 (GB) ..... 1221637.0

(51) Int. Cl.
*G10L 13/00* (2006.01)
*G10L 13/08* (2013.01)
*G10L 13/02* (2013.01)

(52) U.S. Cl.
CPC ..... *G10L 13/08* (2013.01); *G10L 13/02* (2013.01)

(58) Field of Classification Search
None
See application file for complete search history.

(56) References Cited

U.S. PATENT DOCUMENTS 5,165,008 A * 11/1992 Hermansky ..... G10L 19/06 704/258
5,677,984 A 10/1997 Mitome
5,758,320 A * 5/1998 Asano ..... G10L 13/08 704/258
5,822,724 A * 10/1998 Nahumi ..... G10L 19/10 704/219
5,995,924 A * 11/1999 Terry ..... G10L 15/1807 704/207
6,130,949 A * 10/2000 Aoki ..... G10H 3/125 381/94.3
6,665,638 B1 12/2003 Kang et al.

(Continued)

FOREIGN PATENT DOCUMENTS

EP 1 422 693 A1 5/2004
WO WO 2013/011397 A1 1/2013

OTHER PUBLICATIONS

United Kingdom Search Report issued May 27, 2015 in Patent Application No. GB1221637.0.

(Continued)

*Primary Examiner* — Richemond Dorvil
*Assistant Examiner* — Thuykhanh Le
(74) *Attorney, Agent, or Firm* — Oblon, McClelland, Maier & Neustadt, L.L.P

(57) ABSTRACT

A method of deriving speech synthesis parameters from an input speech audio signal, wherein the audio signal is segmented on the basis of estimated positions of glottal closure incidents and the resulting segments are processed to obtain the complex cepstrum used to derive a synthesis filter. A reconstructed speech signal is produced by passing a pulsed excitation signal derived from the position of the glottal closure incidents through the synthesis filter, and compared with the input speech audio signal. The pulse excitation signal and the complex cepstrum are then iteratively modified to minimize the difference between the reconstructed speech signal and the input speech audio signal, by optimizing the position of the pulses in the excitation signal to reduce the mean squared error between the reconstructed speech signal and the input speech audio signal, and recalculating the complex using the optimized pulse positions.

14 Claims, 5 Drawing Sheets

(56) References Cited

U.S. PATENT DOCUMENTS 6,778,603 B1 * 8/2004 Fullerton ..... H04B 1/7172 375/238
6,882,971 B2 * 4/2005 Craner ..... H04M 1/247 704/246
7,058,570 B1 * 6/2006 Yu ..... G10L 19/018 704/219
7,555,432 B1 * 6/2009 Gopalan ..... G10L 19/018 380/252
2002/0052736 A1 5/2002 Kim et al.
2003/0088417 A1 * 5/2003 Kamai ..... G10L 19/04 704/258
2003/0125957 A1 * 7/2003 Puterbaugh ..... G10H 3/125 704/275
2004/0181400 A1 * 9/2004 Kannan ..... G10L 19/107 704/223
2004/0220801 A1 * 11/2004 Sato ..... G10L 19/09 704/207
2006/0145733 A1 * 7/2006 Leary ..... G06F 3/05 327/105
2007/0073546 A1 * 3/2007 Kehren ..... G06Q 50/16 705/313
2007/0198261 A1 * 8/2007 Chen ..... G10L 15/32 704/240
2007/0198263 A1 * 8/2007 Chen ..... G10L 15/065 704/246
2008/0019538 A1 * 1/2008 Kushner ..... A62B 18/08 381/94.1
2012/0004749 A1 * 1/2012 Abeyratne ..... A61B 7/003 700/94
2012/0262534 A1 * 10/2012 Anabuki ..... H04N 7/147 348/14.07
2012/0265534 A1 * 10/2012 Coorman ..... G10L 13/033 704/265
2012/0278081 A1 * 11/2012 Chun ..... G10L 13/02 704/260
2012/0327243 A1 * 12/2012 Rezvani ..... H04W 4/14 348/158
2013/0013313 A1 * 1/2013 Shechtman ..... G10L 13/033 704/260
2013/0110506 A1 * 5/2013 Norvell ..... G10L 19/038 704/205
2013/0138398 A1 * 5/2013 Reza ..... G06F 17/141 702/190
2013/0216003 A1 * 8/2013 Zhuang ..... H04L 25/02 375/316
2013/0268272 A1 * 10/2013 Zhang ..... G10L 17/00 704/243
2014/0142946 A1 * 5/2014 Chen ..... G10L 13/08 704/266
2014/0156284 A1 * 6/2014 Porov ..... G10L 19/0017 704/500

OTHER PUBLICATIONS

Great Britain Combined Search & Examination Report issued Jul. 2, 2013, in Great Britain Application No. 1221637.0 filed Nov. 30, 2012.

Werner Verhelst, et al., "A New Model for the Short-Time Complex Cepstrum of Voiced Speech", IEEE Transactions on Acoustics, Speech, and Signal Processing, vol. ASSP-34, No. 1, Feb. 1986, 9 pages.

Keiichi Tokuda, et al., "Mel-Generated Cepstral Analysis—A Unified Approach to Speech Spectral Estimation", In proceeding of: The 3rd International Conference on Spoken Language Processing, ICSLP 1994, Yokohama, Japan, 1994, 4 pages.

Ranniery Maia, et al., "Complex Cepstrum as Phase Information in Statistical Parametric Speech Synthesis" 2012 IEEE International Conference on Acoustics, Speech and Signal Processing, Mar. 2012, pp. 4581-4584.

* cited by examiner

SPEECH PROCESSING SYSTEM

FIELD

Embodiment of the present invention described herein generally relate to the field of speech processing.

BACKGROUND

A source filter model may be used for speech synthesis or other vocal analysis where the speech is modeled using an excitation signal and a synthesis filter. The excitation signal is a sequence of pulses and can be thought of as modeling the air out of the lungs. The synthesis filter can be thought of as modeling the vocal tract, lip radiation and the action of the glottis.

BRIEF DESCRIPTION OF THE FIGURES

Methods and systems in accordance with embodiments of the present invention will now be described with reference to the following figures.

DETAILED DESCRIPTION

Figure 1:
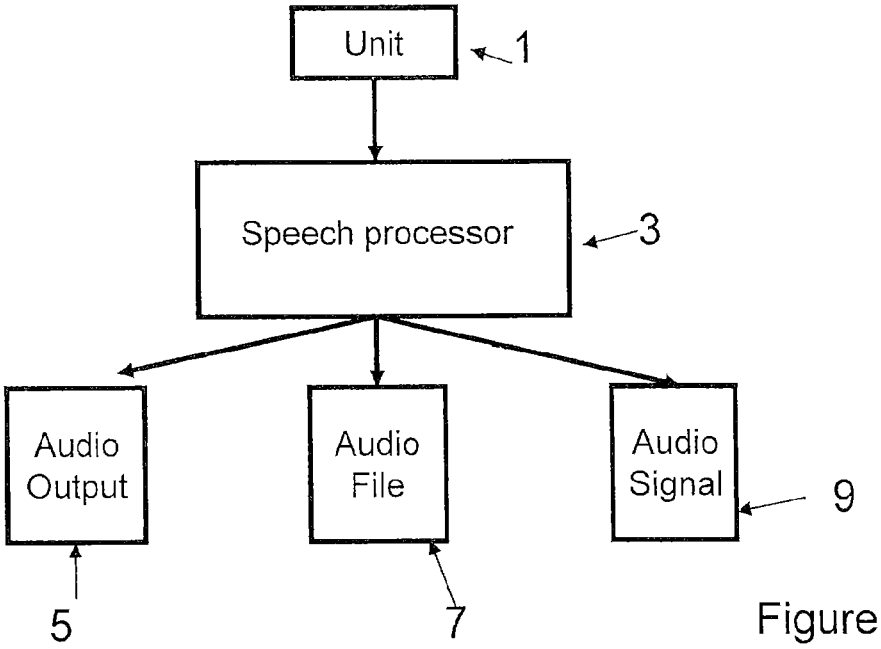
FIG. 1 is a schematic of a very basic speech synthesis system.

In an embodiment, a method of extracting speech synthesis parameters from an audio signal is provided, the method comprising:

receiving an input speech signal;

estimating the position of glottal closure incidents from said audio signal;

deriving a pulsed excitation signal from the position of the glottal closure incidents;

segmenting said audio signal on the basis of said glottal closure incidents, to obtain segments of said audio signal;

processing the segments of the audio signal to obtain the complex cepstrum and deriving a synthesis filter from said complex cepstrum;

reconstructing said speech audio signal to produce a reconstructed speech signal using an excitation model where the pulsed excitation signal is passed through said synthesis filter;

comparing said reconstructed speech signal with said input speech signal; and calculating the difference between the reconstructed speech signal and the input speech signal and modifying either the pulsed excitation signal or the complex cepstrum to reduce the difference between the reconstructed speech signal and the input speech.

In a further embodiment, both the pulsed excitation signal and the complex cepstrum are modified to reduce the difference between the reconstructed speech and the input speech.

Modifying the pulsed excitation signal and the complex cepstrum may comprise the process of:

optimising the position of the pulses in said excitation signal to reduce the mean squared error between reconstructed speech and the input speech; and recalculating the complex cepstrum using the optimised pulse positions, wherein the process is repeated until the position of the pulses and the complex cepstrum results in a minimum difference between the reconstructed speech and the input speech.

The difference between the reconstructed speech and the input speech may be calculated using the mean squared error.

In an embodiment, the pulse height $a_z$ is set such that $a_z=0$ if $a_z<0$ and $a_z=1$ if $a_z>0$ before recalculation of the complex cepstrum. This forces the gain information into the complex cepstral as opposed to the excitation signal.

In one embodiment, re-calculating the complex cepstrum comprises optimising the complex cepstrum by minimising the difference between the reconstructed speech and the input speech, wherein the optimising is performed using a gradient method.

For use with some synthesizers, it is easier perform synthesis using the complex cepstrum, decomposed into phase parameters and minimum phase cepstral components.

The above method may be used for training parameters for use with a speech synthesizer, but it may also be used for vocal analysis. Since the synthesis parameters model the vocal tract, lip radiation and the action of the glottis extracting these parameters and comparing them with either known "normal" parameters from other speakers or even earlier readings from the same speaker, it is possible to analyse the voice. Such analysis can be performed for medical applications, for example, if the speaker is recovering from a trauma to the vocal tract, lips or glottis. The analysis may also be performed to see a speaker is overusing their voice and damage is starting to occur. Measurement of these parameters can also indicate some moods of the speaker, for example, if the speaker is tired, stressed or speaking under duress. The extraction of these parameters can also be used for voice recognition to identify a speaker.

In further embodiments, the extraction of the parameters is for training a speech synthesiser, the synthesiser comprising a source filter model for modeling speech using an excitation signal and a synthesis filter, the method comprising training the synthesis parameters by extracting speech synthesis parameters from an input signal. After the parameters have been extracted or derived, they can be stored in the memory of a speech synthesiser.

When training a speech synthesizer, the excitation and synthesis parameters may be trained separately to the text or with the text input. Where the synthesiser stores text information, during training, it will receive input text and speech, the method comprising extracting labels from the input text, and relating extracted speech parameters to said labels via probability density functions.

In a further embodiment, a text to speech synthesis method is provided, the method comprising:

receiving input text;

extracting labels from said input text;

using said labels to extract speech parameters which have been stored in a memory, and generating a speech signal from said extracted speech parameters wherein said speech signal is generated using a source filter model which produces speech using an excitation signal and a synthesis filter, said speech parameters comprising complex cepstrum parameters.

As noted above, the complex cepstrum parameters may be stored in said memory as minimum phase cepstrum parameters and phase parameters, the method being configured to produce said excitation signal using said phase parameters and said synthesis filter using said minimum phase cepstrum parameters.

A system for extracting speech synthesis parameters from an audio signal is provided in a further embodiment, the system comprising a processor adapted to:

receive an input speech signal;

estimate the position of glottal closure incidents from said audio signal;

derive a pulsed excitation signal from the position of the glottal closure incidents;

segment said audio signal on the basis of said glottal closure incidents, to obtain segments of said audio signal;

process the segments of the audio signal to obtain the complex cepstrum and deriving a synthesis filter from said complex cepstrum;

reconstruct said speech audio signal to produce a reconstructed speech signal using an excitation model where the pulsed excitation signal is passed through said synthesis filter;

compare said reconstructed speech signal with said input speech signal; and calculate the difference between the reconstructed speech signal and the input speech signal and modifying either the pulsed excitation signal or the complex cepstrum to reduce the difference between the reconstructed speech signal and the input speech.

In a further embodiment, a text to speech system is provided, the system comprising a memory and a processor adapted to:

receive input text;

extract labels from said input text;

use said labels to extract speech parameters which have been stored in the memory; and generate a speech signal from said extracted speech parameters wherein said speech signal is generated using a source filter model which produces speech using an excitation signal and a synthesis filter, said speech parameters comprising complex cepstrum parameters.

Since the present invention can be implemented by software, the present invention encompasses computer code provided to a general purpose computer on any suitable carrier medium. The carrier medium can comprise any storage medium such as a floppy disk, a CD ROM, a magnetic device or a programmable memory device, or any transient medium such as any signal e.g. an electrical, optical or microwave signal.

FIG. 1 is a schematic of a very basic speech processing system, the system of FIG. 1 has been configured for speech synthesis. Text is received via unit 1. Unit 1 may be a connection to the internet, a connection to a text output from a processor, an input from a speech to speech language processing module, a mobile phone etc. The unit 1 could be substituted by a memory which contains text data previously saved.

The text signal is then directed into a speech processor 3 which will be described in more detail with reference to FIG. 2.

The speech processor 3 takes the text signal and turns it into speech corresponding to the text signal. Many different forms of output are available. For example, the output may be in the form of a direct audio output 5 which outputs to a speaker. This could be implemented on a mobile telephone, satellite navigation system etc. Alternatively, the output could be saved as an audio file 7 and directed to a memory. Also, the output could be in the form of an electronic audio signal which is provided to a further system 9.

Figure 2:
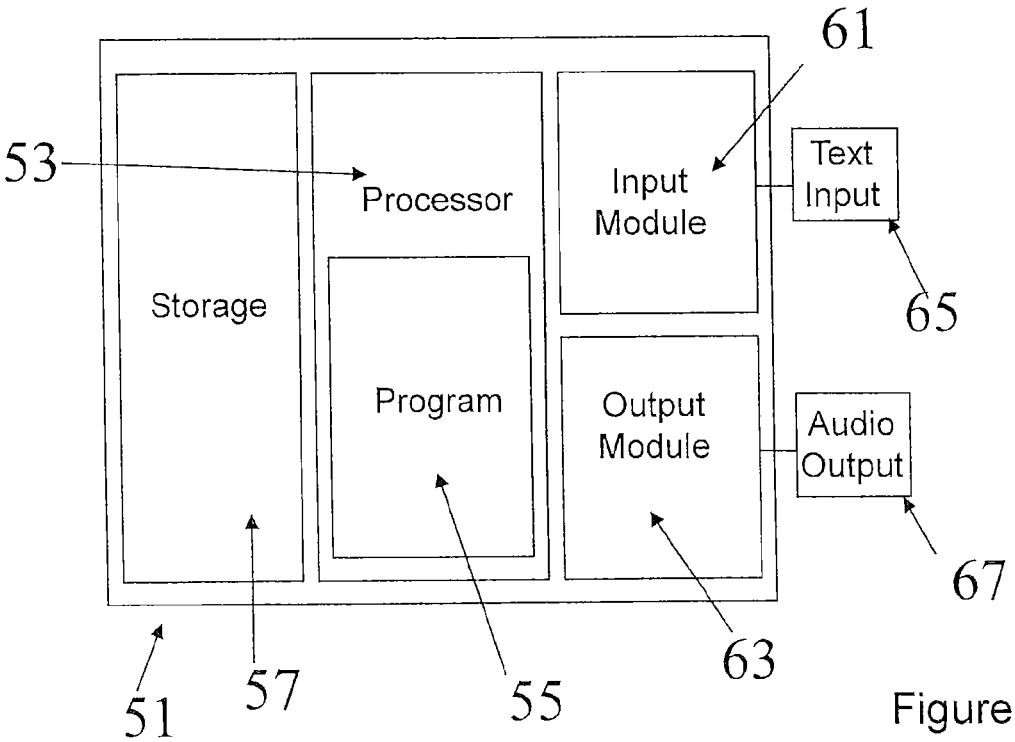
FIG. 2 is a schematic of the architecture of a processor configured for text-to-speech synthesis.

FIG. 2 shows the basic architecture of a text to speech system 51. The text to speech system 51 comprises a processor 53 which executes a program 55. Text to speech system 51 further comprises storage 57. The storage 57 stores data which is used by program 55 to convert text to speech. The text to speech system 51 further comprises an input module 61 and an output module 63. The input module 61 is connected to a text input 65. Text input 65 receives text. The text input 65 may be for example a keyboard. Alternatively, text input 65 may be a means for receiving text data from an external storage medium or a network.

Connected to the output module 63 is output for audio 67. The audio output 67 is used for outputting a speech signal converted from text input into text input 63. The audio output 67 may be for example a direct audio output e.g. a speaker or an output for an audio data file which may be sent to a storage medium, networked etc.

In use, the text to speech system 51 receives text through text input 63. The program 55 executed on processor 53 converts the text into speech data using data stored in the storage 57. The speech is output via the output module 65 to audio output 67.

Figure 3:
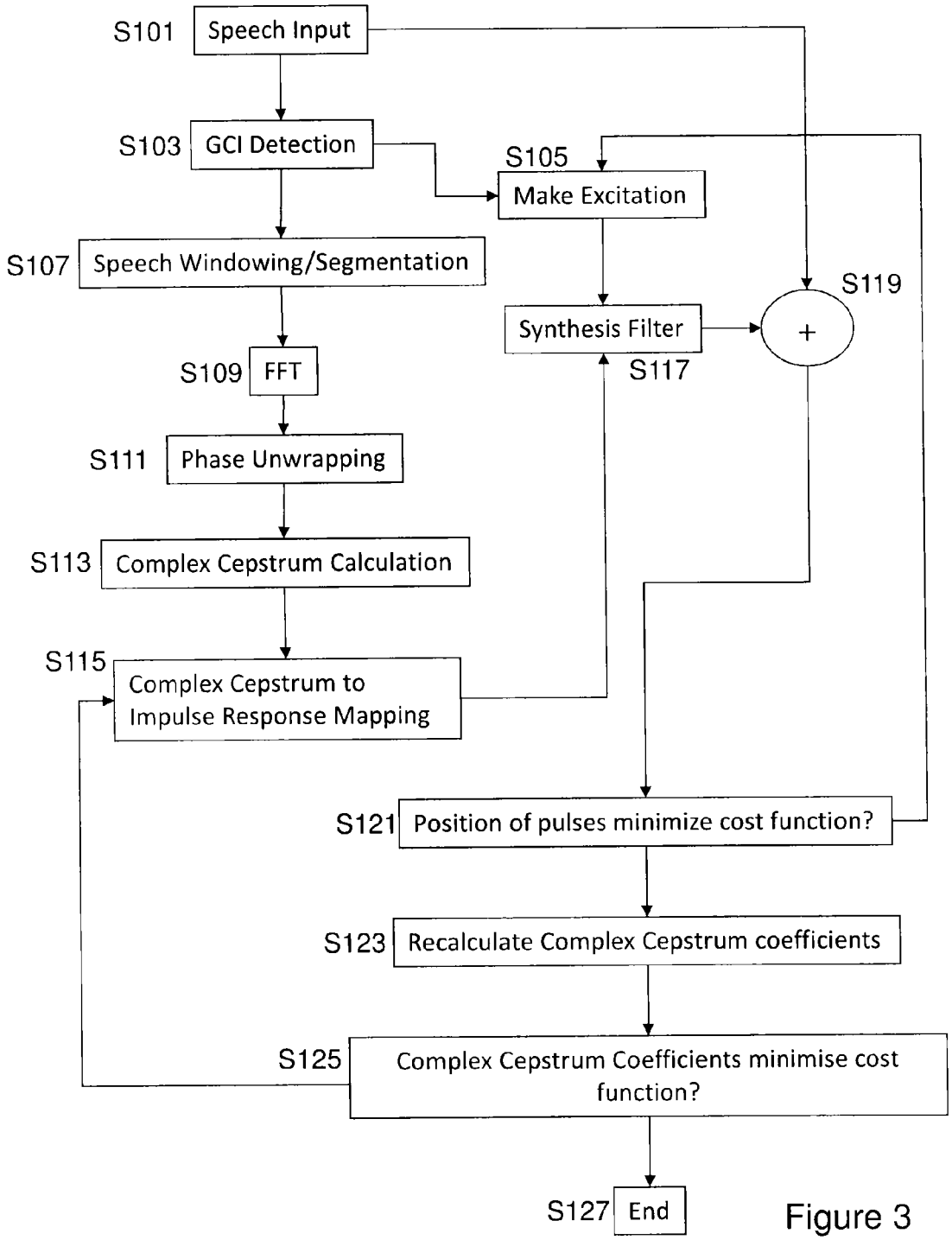
FIG. 3 is a flow diagram showing the steps of extracting speech parameters in accordance with an embodiment of the present invention.

FIG. 3 shows a flow chart for training a speech synthesis system in accordance with an embodiment of the present invention. In step S101 speech s(n) is input. The speech is considered to be modeled by:

$$s(n)=h(n)*e(n) \tag{1}$$

where h(n) is a slowly varying impulse response representing the effects of the glottal flow, vocal tract, and lip radiation. The excitation signal e(n) is composed of delta pulses (amplitude one) or white noise in the voiced and unvoiced regions of the speech signal, respectively. The impulse response h(n) can be derived from the speech signal s(n) through cepstral analysis.

Figure 4:
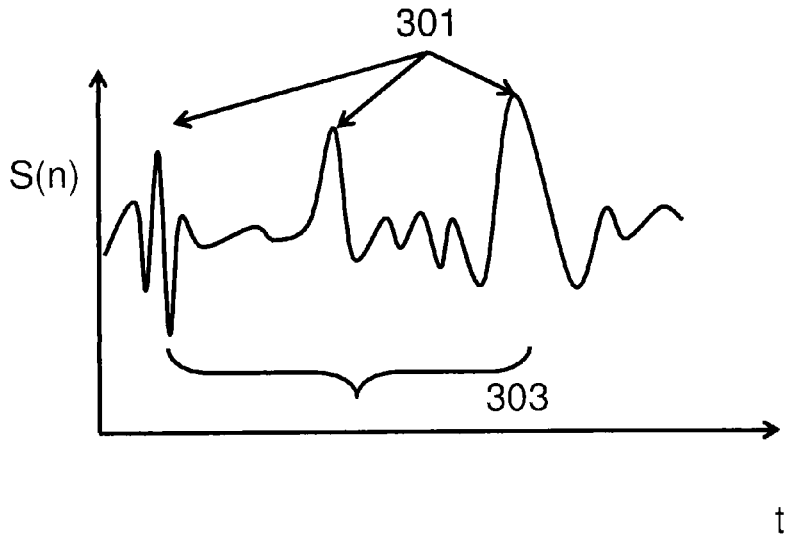
FIG. 4 is a schematic of a speech signal demonstrating how to segment the input speech for initial cepstral analysis.

First, the excitation is initialised. In step S103, glottal closure incidents (GCIs) are detected from the input speech signal s(n). There are many possible methods of detecting GCIs for example, based on the autocorrelation sequence of the speech waveform. FIG. 4 shows a schematic trace of a speech signal over time of the type which may be input at step S101. GCIs 201 are evidenced by large maxima in the signal s(n), normally referred to as pitch period onset times.

These GCIs are then used to produce the first estimate of the positions of the pulses in the excitation signal in step S105.

Next, the signal is segmented in step S107 in time to form segments of speech on the basis of the detected GCIs 301. In an embodiment the windowed portions of the speech signal $s_w(n)$ are set to run from the previous GCI to the following GCI as shown by window 303 in FIG. 4.

Figure 5:
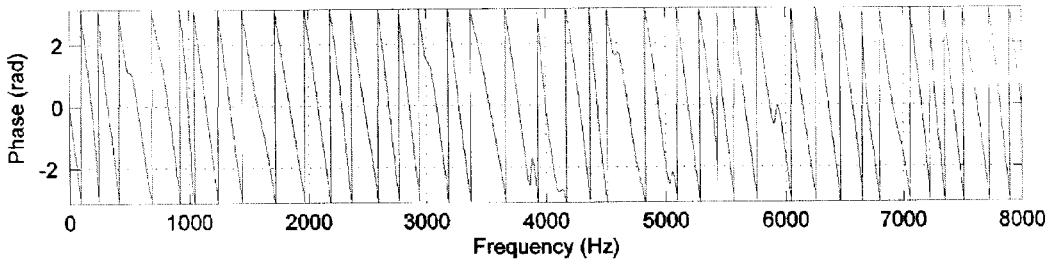
FIG. 5 is a plot showing a wrapped phase signal.

The signal is then subjected to FFT in step S109 so that $s_w(n)$ is converted to the Fourier domain $s_w(\omega)$. A schematic of the phase response after this stage is shown in FIG. 5 where it can be seen that the phase response is non-continuous. The phase response is "wrapped" (or in other ways to say it contains only its principal value) because of the usual way in which the phase response is calculated, by taking the arc tan of the ratio of the imaginary and real parts of $s_w(\omega)$. This phase signal needs to be unwrapped to allow calculation complex cepstral coefficients. This unwrapping procedure is achieved in step S111. In one embodiment, phase unwrapping is performed by checking the difference in phase response between two consecutive frequencies and adding $2\pi$ to phase response of the succeeding frequency.

Next, in step S113, the complex cepstrum calculation is performed to derive the cepstral representation of h(n).

The cepstral domain representation of s(n) is $$\hat{s}(n) = \frac{1}{2\pi}\int_{-\pi}^{\pi}\{\ln|S(e^{j\omega})| + j\theta(\omega)\}e^{j\omega n}d\omega. \tag{2}$$

$$S(e^{j\omega}) = \sum_{n=-\infty}^{\infty} s(n)e^{-j\omega n} = |S(e^{j\omega})|e^{j\theta(\omega)}. \tag{3}$$

Where $|S(e^{j\omega})|$ and $\theta(\omega)$ are respectively the amplitude and phase spectrum of s(n). $\hat{s}(n)$ is by definition an infinite and non-causal sequence. If pitch synchronous analysis with an appropriate window to select two pitch periods is performed, then samples of $\hat{s}(n)$ tend to zero as $n\rightarrow\infty$. If the signal e(n) is a delta pulse or white noise, then a cepstral representation of h(n), here defined as the complex cepstrum of s(n) can be given by $\hat{h}(n)=\hat{s}(n)$ so that $|n|\leq C$, where C is the cepstrum order.

At synthesis time, which will be discussed later, the complex cepstrum of s(n), $\hat{h}(n)$ is converted into the synthesis filter impulse response h(n) in step S115.

$$H(e^{j\omega}) = \exp\sum_{n=-C}^{C}\hat{h}(n)e^{-j\omega n}, \tag{4}$$

$$h(n) = \frac{1}{2\pi}\int_{-\pi}^{\pi}H(e^{j\omega})e^{j\omega n}d\omega. \tag{5}$$

The above explained complex cepstrum analysis is very sensitive to the position and shape of the analysis window as well as to the performance of the phase unwrapping algorithm which is used to estimate the continuous phase response $\theta(\omega)$.

In step S117 h(n) derived from step S115 is excited by e(n) to produce the synthesised speech signal $\tilde{s}(n)$. The excitation signal e(n) is composed of pulses located at the glottal closure instants. In this way, only the voiced portions of the speech signal are taken into account.

Therefore, its is assumed that the initial cepstrum fairly represents the unvoiced regions of the input speech signal s(n) in step S101.

In step S119, the synthesised speech signal (n) is compared with the original input speech s(n):

$$w(n)=s(n)-\tilde{s}(n)=s(n)-e(n)*h(n). \tag{6}$$

In step S121, the positions of the pulses of the excitation signal e(n), representing the pitch period onset times, are optimized given initial complex cepstrum $\hat{h}(n)$. Next, in step S123, the complex cepstrum $\hat{h}(n)$ for each pre-specified instant in time is estimated given the excitation signal e(n) with updated pulse positions. Both procedures are conducted in a way that the mean squared error (MSE) between natural, s(n), and reconstructed speech, $\tilde{s}(n)$ is minimized. In the following sections these procedures are described.

In step S121, this procedure is conducted by keeping H(z) for each frame $t=\{0, \ldots, T-1\}$, where T is the number of frames in the sentence, constant, and minimizing the mean squared error of the system of FIG. 1 by updating the positions, $\{p_0, \ldots, p_{Z-1}\}$, and amplitudes, $\{a_0, \ldots, a_{Z-1}\}$, of e(n), where Z is the number of pulses or number of GCIs.

Considering matrix notation, the error signal w(n) can be written as:

$$w = s - \tilde{s} = s - He, \tag{7}$$

Where $$s = \left[\underbrace{0\ \ldots\ 0}_{\frac{M}{2}}\ \ s(0)\ \ \ldots\ \ s(N-1)\ \ \underbrace{0\ \ldots\ 0}_{\frac{M}{2}}\right]^T, \tag{8}$$

$$e = [\,e(0)\ \ \ldots\ \ e(N-1)\,]^T. \tag{9}$$

with s being a N+M-size vector whose elements are samples of the natural speech signal s(n), e contains samples of the excitation signal e(n), M is the order of h(n), and is N the number of samples of s(n). The (M+N)×N matrix H has the following shape.

$$H = [\,g_0\ \ \ldots\ \ g_{N-1}\,], \tag{10}$$

$$g_n = \left[\underbrace{0\ \ldots\ 0}_{n}\ \ h_n^T\ \ \underbrace{0\ \ldots\ 0}_{N-n-1}\right]^T, \tag{11}$$

$$h_n = \left[h_n\left(-\frac{M}{2}\right)\ \ \ldots\ \ h_n\left(\frac{M}{2}\right)\right]^T, \tag{12}$$

where $h_n$ contains the impulse response of H(z) at the n-th sample position.

Considering that the vector e has only Z non-zero samples (voiced excitation), then $\tilde{s}$ can be written as $$\tilde{s} = He = \sum_{z=0}^{Z-1} a_z g_z, \tag{13}$$

where $\{a0, \ldots, aZ-1\}$ are the amplitudes the non-zero samples of e(n).

The mean squared error of the system is the term to be minimized, $$s = \frac{1}{N}w^T w = \frac{1}{N}\left(s - \sum_{z=0}^{Z-1} a_z g_z\right)^T\left(s - \sum_{s=0}^{Z-1} a_z g_z\right). \tag{14}$$

The optimal pulse amplitude $\hat{a}_z$ which minimizes (13) can be given by $\partial\epsilon/\partial a_z=0$, which results in $$\hat{a}_z = \frac{g_z^T\left(s - \sum_{\substack{i=0\\ i\neq z}}^{Z-1} a_i g_i\right)}{g_z^T g_z}. \tag{15}$$

By substituting (15) into (14), an expression for the error considering the estimated amplitude $\hat{a}_z$ can be achieved $$\varepsilon_{\hat{a}_z} = s^T s - 2s^T \sum_{\substack{i=0\\ i\neq z}}^{Z-1} a_i g_i + \sum_{\substack{i=0\\ i\neq z}}^{Z-1} a_i^2 g_i^T g_i + \sum_{\substack{i=0\\ i\neq z}}^{Z-1} a_i g_i^T \left(\sum_{\substack{r=0\\ r\neq z}}^{Z-1} a_r g_r\right) - \frac{\left[g_z^T\left(s - \sum_{\substack{i=0\\ i\neq z}}^{Z-1} a_i g_i\right)\right]^2}{g_z^T g_z}, \tag{16}$$

where it can be seen that the only term which depends on the z-th pulse is the last one in the right side of (16). Therefore, the estimated position $\hat{p}_z$ is the one which minimizes $\epsilon_{\hat{a}_z}$ i.e., $$\hat{p}_z = \underset{p_z = p_z - \frac{\Delta p}{2}, \ldots, p_z + \frac{\Delta p}{2}}{\operatorname{argmax}} \frac{\left[g_z^T\left(s - \sum_{\substack{i=0\\ i\neq z}}^{Z-1} a_i g_i\right)\right]^2}{g_z^T g_z}. \tag{17}$$

The term $\Delta p$ is the range of samples in which the search for the best position in the neighbourhood of $p_z$ is conducted.

Figure 6:
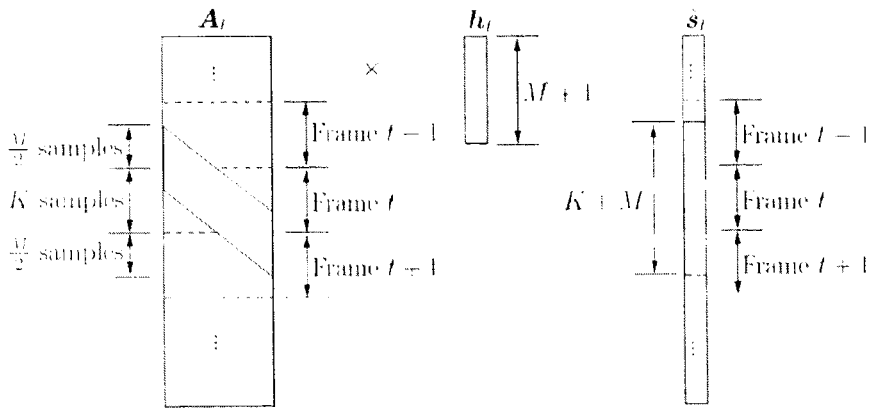
FIG. 6 is a schematic showing how the complex cepstrum is re-estimated in accordance with an embodiment of the present invention.

In step S123, the complex cepstrum is re-estimated. In order to calculate the complex cepstrum based on the minimum MSE, a cost function must be defined in step S125. Because the impulse response h(n) is associated with each frame t of the speech signal, the reconstructed speech vector $\tilde{s}$ can be written in matrix form as $$\tilde{s} = \sum_{t=0}^{T-1} A_t h_t, \tag{18}$$

where T is the number of frames in the sentence, and $$h_t = \left[h_t\left(-\frac{M}{2}\right) \ldots , h_t\left(\frac{M}{2}\right)\right]^T$$

are the synthesis filter coefficients vector at the t-th frame of s(n). The (K+M)×(M+1) matrix $A_t$ is given by $$A_t = \left[u_{-\frac{M}{2}} \ldots u_{\frac{M}{2}}\right], \tag{19}$$

$$u_m = \left[\underbrace{0 \ldots 0}_{\frac{M}{2}+m} \quad e_t^T \quad \underbrace{0 \ldots 0}_{\frac{M}{2}m}\right]^T, \tag{20}$$

$$e_t = \left[\underbrace{0 \ldots 0}_{tK} e(tK) \ldots e((t+1)K-1) \quad \underbrace{0 \ldots 0}_{N-(t+1)K}\right]^T, \tag{21}$$

where $e_t$ is the excitation vector where only samples belonging to the t-th frame are non-zero, and K is the number of samples per frame. FIG. 6 gives and illustration of the matrix product $A_t h_t$.

By considering (17), the MSE can be written as $$\varepsilon = \frac{1}{N}\left(s - \sum_{t=0}^{T-1} A_t h_t\right)^T \left(s - \sum_{t=0}^{T-1} A_t h_t\right). \tag{22}$$

The optimization is performed in the cepstral domain. The relationship between the impulse response vector $h_t$ and its corresponding complex cepstrum vector $\hat{h}_t = [\hat{h}_t(-C) \ldots \hat{h}_t(C)]^T$, can be written by $$\begin{aligned} h_t &= f(\hat{h}_t) \\ &= \frac{1}{2L+1} D_2 \exp(D_1 \hat{h}_t). \end{aligned} \tag{23}$$

where exp (•) means a matrix formed by taking the exponential of each element of the matrix argument, and L is the number of one-sided sampled frequencies in the spectral domain. The elements of the (2L+1)×(2C+1) matrix $D_1$, and the (M+1)×(2L+1) matrix $D_2$ are given by $$D_1 = \begin{bmatrix} e^{-j\omega_{-L}(-C)} & \ldots & e^{-j\omega_{-L}C} \\ \vdots & & \vdots \\ e^{-j\omega_L(-C)} & \ldots & e^{-j\omega_L C} \end{bmatrix}, \tag{24}$$

$$D_2 = \begin{bmatrix} e^{j\omega_{-L}(-\frac{M}{2})} & \ldots & e^{j\omega_L(-\frac{M}{2})} \\ \vdots & & \vdots \\ e^{j\omega_{-L}\frac{M}{2}} & \ldots & e^{j\omega_L\frac{M}{2}} \end{bmatrix},$$

where $\{\omega_{-L}, \ldots, \omega_L\}$ are the sampled frequencies in the spectrum domain, with $\omega_0=0$, $\omega_L=\pi$, and $\omega_{-l}=-\omega_l$. It should be noted that warping can be used by implemented by appropriately selecting the frequencies $\{\omega_{-L}, \ldots, \omega_L\}$. By substituting (22) into (21) a cost function relating the MSE with $\hat{h}_t$ is obtained $$\varepsilon(\hat{h}_t) = \frac{1}{N}\left[r_t^T r_t - 2r_t A_t f(\hat{h}_t) + f(\hat{h}_t^T) A_t^T A_t f(h_t)\right], \tag{25}$$

where $$r_t = s - \sum_{j=0, j\neq t}^{T-1} A_j f(\hat{h}_j). \tag{26}$$

Since the relationship between cepstrum and impulse response, $h_t = f(\hat{h}_t)$, is nonlinear, a gradient method is utilized to optimize the complex cepstrum. Accordingly, a new re-estimation or the complex cepstrum is given by $$\hat{h}_t^{(i+1)} = \hat{h}_t^{(i)} - \gamma \frac{\nabla_{\hat{h}_t} \varepsilon(\hat{h}_t)}{\|\nabla_{\hat{h}_t} \varepsilon(\hat{h}_t)\|}, \tag{27}$$

where $\gamma$ is a convergence factor, and $\nabla_{\hat{h}_t}\epsilon(\hat{h}_t)$ is the gradient of $\epsilon$ with respect to $\hat{h}_t$, and i is an iteration index. The gradient vector can be calculated by using the chain rule:

$$\nabla_{\hat{h}_t}\varepsilon = \frac{\partial h_t}{\partial \hat{h}_t}\frac{\partial \varepsilon}{\partial h_t}, \tag{28}$$

which results in:

$$\nabla_{\hat{h}_t}\varepsilon = (\hat{h}_t) = -\frac{2}{N(2L+1)}D_1^T diag\left(\exp\left(D_2\hat{h}_t\right)\right)D_2^T A_t^T\left[r_L - A_t f(\hat{h}_t)\right], \tag{29}$$

where diag(•) means a diagonal matrix formed with the elements of the argument vector.

In an embodiment, the method may use the following algorithm where the index i indicates iteration number for the complex cepstrum re-estimation procedure described in relation to steps S123 to S125.

1) Initialize $\{p_0, \ldots, p_{Z-1}\}$ as the instants used for initial cepstrum calculation 2) Make $a_z=1$, $0 \le z < Z-1$ 3) Get an initial estimate of the complex cepstrum for each frame: $\{\hat{h}_0^{(0)}, \ldots, \hat{h}_{T-1}^{(0)}\}$ Recursion 1) For each pulse position $\{p_0, \ldots, p_{Z-1}\}$ 1.1) Determine the best position $\hat{p}_z$ using equation 17

1.2) Update the optimum amplitude $\hat{a}_z$ using equation 15

2) For each pulse amplitude $\{a_0, \ldots, a_{Z-1}\}$ 2.1) Make $a_z=0$ if $a_z<0$ or $a_z=1$ if $a_z>0$ 3) For each frame $\{t=0, \ldots, T-1\}$ 3.1) For i=1, 2, 3 . . .

3.1.1) Estimate according to equation 27.

3.2) Stop when $$10\log_{10}\left(\frac{\varepsilon\left(\hat{h}_t^{(i+1)}\right)}{\varepsilon\left(\hat{h}_t^{(i)}\right)}\right) \ge 0 \text{ dB}$$

4) If the SNRseg between natural and reconstructed speech is below a desirable threshold, go to Step 1

5) Stop

Initialization for the algorithm in Table 1 can be done by conventional complex cepstrum analysis. The glottal closure instants can be used to represent the positions $\{p_0, \ldots, pZ-1\}$. Estimates of the initial frame-based complex cepstra $\{\hat{h}_0, \ldots \hat{h}_{T-1}\}$ can be taken in several ways.

The simplest form would be to consider $\hat{h}_t$ equal to the complex cepstrum obtained in the GCI immediately before frame t. Other possible ways are interpolation of pitch-synchronous cepstra over the frame, or interpolation of amplitude and phase spectra.

Assuming that the initial GCIs do not need to be accurate, during the pulse optimization process, negative amplitudes $a_z<0$ are strong indicators that the corresponding GCIs should not be there, whereas high amplitudes indicate that one or more pulses are missing. To solve the first problem, amplitudes are set to zero $a_z=0$ whenever the algorithm finds that the amplitudes are negative (recursive step 2). Such empirical solution assumes that there is not polarity reversal during in the initial complex cepstra.

By forcing the condition $a_z=1$ if $a_z>0$, the above algorithm forces the gain information into the complex cepstral as opposed to the excitation signal.

Stopping criterion can be based on the segmental signal-to-noise ratio (SNRseg) between natural and reconstructed speech or maximum number of iterations. A SNRseg>15~dB would mean that the reconstructed speech is fairly close to its natural version. However, sometimes this value can not be reached due to the poor estimates of the initial complex cepstrum and corresponding GCIs. Usually 5 iterations are adequate to reach convergence.

Although the above discussion has referred to optimising both the complex cepstral and the excitation signal, for speech synthesis it is important to include the gain information in these parameters, therefore eliminating the need to store the excitation pulse amplitudes.

A method for complex cepstrum optimization has been proposed. The approach searches for the best pitch onset position given initial estimates of the complex cepstrum, followed by complex cepstrum re-estimation. The mean squared error between natural and synthesized speech is minimized during the optimization process. During complex cepstrum re-estimation, no windowing or phase unwrapping is performed.

Figure 7:
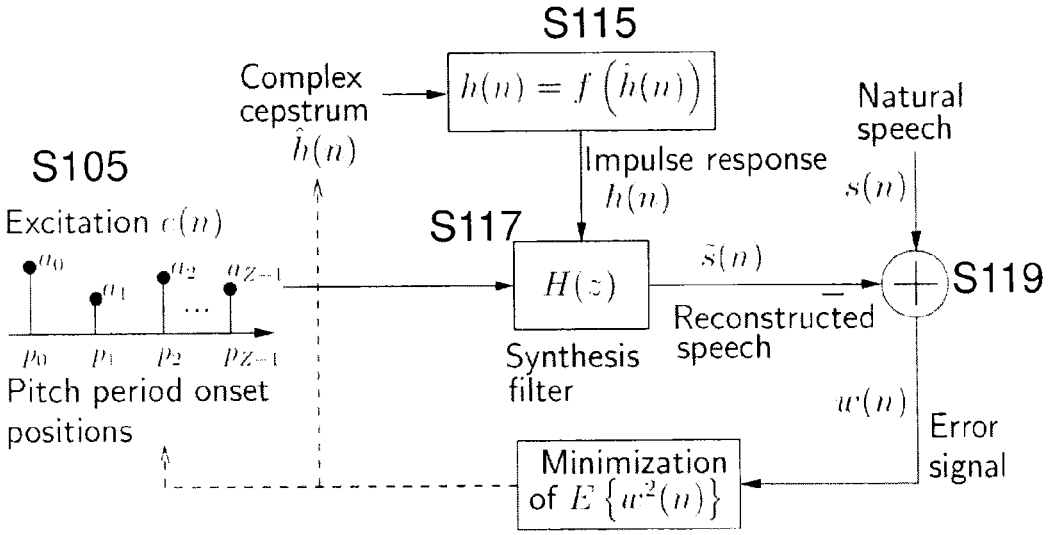
FIG. 7 is a flow diagram showing the feedback loop of a method in accordance with an embodiment of the present invention.

FIG. 7 shows a summary of the feedback loop of FIG. 3. To avoid unnecessary repetition, like reference numerals will be used to denote like features. The excitation signal which is produced in step S105 is shown as a pulsed signal which is input to synthesis filter S117 which receives the impulse response function h(n) from step S115 to produce synthesised speech. The synthesised speech $\tilde{s}(n)$ is then compared with the original input speech at step S119 to produce error signal w(n). The error signal is then minimised using feedback loop which, in this embodiment, serves to both optimise the excitation signal and the complex cepstrum coefficients. However, it is also possible for the feedback loop to just optimise one of e(n) or h(n).

Deriving the complex cepstrum means that the speech signal in its full representation is being parameterised. By extracting the complex cepstrum through the minimisation of the mean squared error between natural and synthetic speech means that a more accurate representation of the speech signal can be achieved. This can result in speech synthesizer which can achieve better quality and expressiveness.

The above method produces synthesis filter parameters and excitation signal parameters derived from the complex cepstrum of an input speech signal. In addition to these, when training a system for speech synthesis other parameters will also be derived. In an embodiment, the input to such a system will be speech signals and corresponding input text.

From the input speech signals, the complex cepstrum parameters are derived as described in relation to FIG. 3. In addition, the fundamental frequencies ($F_0$) and aperiodicity parameters will also be derived. The fundamental frequency parameters are extracted using algorithms which are well known in the art. It is possible to derive the fundamental frequency parameters from the pulse train derived from the excitation signal as described with reference to FIG. 3. However, in practice, F0 is usually derived by an independent method. Aperiodicity parameters are also estimated separately. These allow the sensation of "buzz" to be removed from the reconstructed speech. These parameters are extracted using known statistical methods which separate the input speech waveform into periodic and aperiodic components.

Labels are extracted from the input text. From these statistical models are then trained which comprise means and variances of the synthesis filter parameters (derived from the complex cepstrum as described above), the log of the fundamental frequency F0, the aperiodicity components and phoneme durations are then stored. In an embodiment, the parameters will be clustered and stored as decision trees with the leaves of the tree corresponding to the means and variances of a parameters which correspond to a label or a group of labels.

In an embodiment, the system of FIG. 3 is used to train a speech synthesizer which uses an excitation model to produce speech. Adapting a known speech synthesiser to use a complex cepstrum based synthesizer can require a lot of adaptation to the synthesiser. In an alternative embodiment, the complex cepstrum is decomposed into minimum phase and all pass component. For example for a given sequence x(n), for which the complex cepstrum $\hat{x}(n)$ exists, can be decomposed into its minimum-phase, $x_m(n)$, and all-pass, $x_a(n)$, components. Thus:

$$x(n)=x_m(n)*x_a(n). \tag{30}$$

The minimum-phase cepstrum, $\hat{x}_m(n)$ is a causal sequence and can be obtained from the complex cepstrum, $\hat{x}(n)$ as follows:

$$\hat{x}_m(n)=\begin{cases}0, & n=-C,\ldots,-1,\\ \hat{x}(n), & n=0,\\ \hat{x}(n)+\hat{x}(-n), & n=1,\ldots,C,\end{cases} \tag{31}$$

where C is the cepstral order. The all-pass cepstrum $\hat{x}_a(n)$ can then be simply retrieved from the complex and minimum-phase cepstrum as $$\hat{x}_a(n)=\hat{x}(n)-\hat{x}_m(n),\ n=-C,\ldots,C. \tag{32}$$

By substituting (31) into (32) it can be noticed that the all-pass cepstrum $\hat{x}_a(n)$ is non-causal and anti-symmetric, and only depends on the non-causal part of $\hat{x}(n)$ $$\hat{x}_a(n)=\begin{cases}\hat{x}(n), & n=-C,\ldots,-1,\\ 0, & n=0,\\ -\hat{x}(-n), & n=1,\ldots,C,\end{cases} \tag{33}$$

Therefore, $\{\hat{x}(-C),\ldots,\hat{x}(-1)\}$ carries the extra phase information which is taken into account when using complex cepstrum analysis. For use in acoustic modeling phase parameters are derived, defined as the non-causal part of $\hat{x}(n)$.

$$\phi(n)=-\hat{x}(-n-1)=\hat{x}_a(n+1),\ n=0,\ldots,C_a, \tag{34}$$

where Ca<C is the order of the phase parameters.

When training parameters for use in systems of the above described types, the complex cepstrum based synthesis filter can be realized as the cascade of an all pass filter, derived from the phase parameters, and where only the phase information is modified and all other information is preserved, and a minimum phase filter, derived from the minimum-phase cepstrum. In such systems, the training method will comprise a further step of decomposing the complex cepstrum into phase and minimum phase components. These parameters can be used to from decision trees and pre-stored in a synthesiser product.

Figure 8:
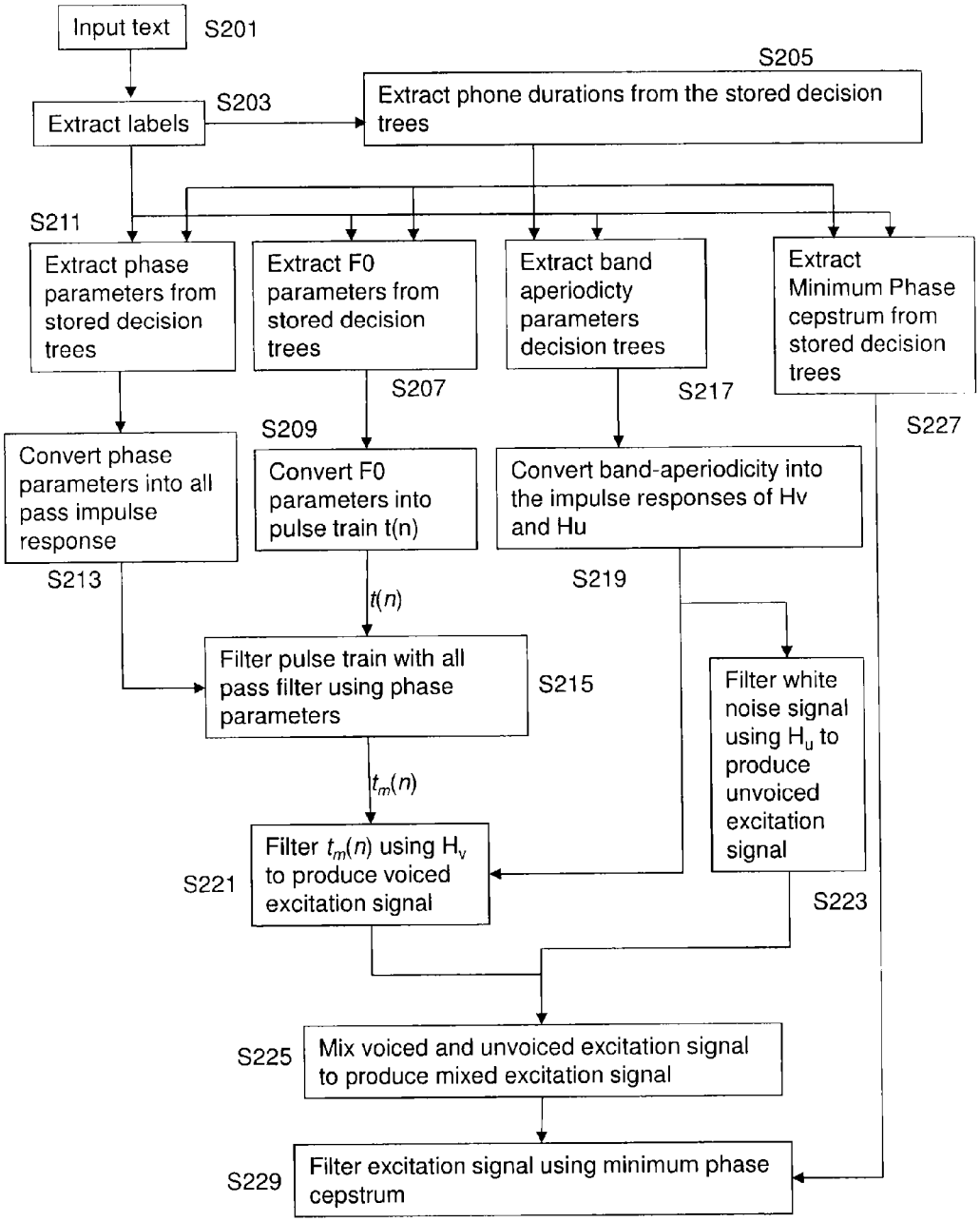
FIG. 8 is a flow diagram showing a method of speech synthesis in accordance with an embodiment of the present invention.

FIG. 8 is a schematic of a method which such a synthesiser product could perform. The synthesiser can be of the type described with reference to FIG. 2. Pre-stored in the memory 57 are:

1) means and variances of the minimum phase cepstrum parameters;

2) means and variances of the fundamental frequency;

3) means and variances of the aperiodicity components;

4) means and variances of the phoneme durations;

5) means and variances of the phase parameters. and 1) decision trees for the minimum phase cepstrum parameters 2) decision trees for the fundamental frequency;

3) decision trees for the aperiodicity components;

4) decision trees for the phoneme durations;

5) decision trees for the phase parameters.

Text is input at step S201. Labels are then extracted from this text in step S203. The labels give information about the type of phonemes in the input text, context information etc. Then, the phone durations are extracted in step S205, from the stored decision trees and means and variances for phone duration. Next, by using both the labels and generated durations the other parameters are generated.

In step S207, F0 parameters are extracted using the labels and the phone durations. The F0 parameters are converted into a pulse train t(n) in step S209.

In step S211 which may be performed concurrently, before or after step S207, the phase parameters are extracted from the stored decision trees and means and variances for phase. These phase parameters are then converted to into an all pass impulse response in step S213. This filter is then used to in step S215 to filter the pulse train t(n) produced in step S209.

In step S217, band aperiodicity parameters are extracted from stored decision trees. The band-aperiodicity parameters are interpolated to result in L+1 aperiodicity coefficients $\{\alpha 0,\ldots,\alpha L\}$. The aperiodicity parameters are used to derive the voiced $H_v$ and unvoiced $H_u$ filter impulse in step S219.

The voiced filter impulse is applied to the filtered voice pulse train $t_m(n)$ in step S221. A white noise signal, generated by a white noise generator, is input to the system to represent the unvoiced part of the signal and this is filtered by the unvoiced impulse response in step S223.

The voiced excitation signal which has been produced in step S221 and the unvoiced excitation signal which has been produced in step S223 are then mixed to produce mixed excitation signal in step S225.

The minimum phase cepstrum parameters are then extracted in step S227 using the text labels and phone durations. The mixed excitation signal is then filtered in step S229 using minimum phase cepstrum signal to produce the reconstructed voice signal.

Although the above description has been mainly concerned with the extraction of an accurate complex cepstrum for the purposes of training a speech synthesiser, the systems and methods described above have applications outside that of speech synthesis. For example, because h(n) contains information of the glottal flow (glottal effect on the air that passes though the vocal tract), h(n) gives information on the quality/style of the voice of the speaker, such as if he/she is tense, angry, etc, as well as being used for voice disorder detection.

Therefore, the detection of h(n) can be used for voice analysis.

While certain embodiments have been described, these embodiments have been presented by way of example only, and are not intended to limit the scope of the inventions. Indeed novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

The invention claimed is:

1. A method of deriving speech synthesis parameters from an audio signal, the method performed in a device comprising a processor, the method comprising:

receiving an input speech audio signal;

estimating a position of glottal closure incidents from said input speech audio signal;

deriving a pulsed excitation signal from the position of the glottal closure incidents;

segmenting said audio signal on the basis of said glottal closure incidents, to obtain segments of said input speech audio signal;

processing the segments of the input speech audio to obtain a complex cepstrum and deriving a synthesis filter from said complex cepstrum;

producing a reconstructed speech signal based on the input speech audio signal by passing the pulsed excitation signal derived from the position of the glottal closure incidents through said synthesis filter derived from said complex cepstrum;

comparing said reconstructed speech signal with said input speech audio signal;

calculating a difference between the reconstructed speech signal and the input speech audio signal and modifying the pulsed excitation signal and the complex cepstrum to reduce the difference between the reconstructed speech signal and the input speech audio signal, wherein modifying the pulsed excitation signal and the complex cepstrum comprises the process of:

optimizing the position of the pulses in said excitation signal to reduce a mean between the reconstructed speech signal and the input speech audio signals;

recalculating the complex cepstrum by optimizing the complex cepstrum by minimizing the difference between the reconstructed speech signal and the input speech audio signal using the optimized pulse positions, and repeating the process to derive as said speech synthesis parameters the position of the pulses and the complex cepstrum resulting in a minimum difference between the reconstructed speech signal and the input speech audio signal.

2. A method according to claim 1, wherein the difference between the reconstructed speech signal and the input speech audio signal is calculated using the mean squared error.

3. A method according to claim 1, wherein the pulse height $a_z$ is set such that $a_z=0$ if $a_z<0$ and $a_z=1$ if $a_z>0$ before recalculation of the complex cepstrum.

4. A method according to claim 1, wherein optimizing the complex cepstrum is performed using a gradient method.

5. A method according to claim 1, further comprising decomposing the complex cepstrum into phase and minimum phase cepstral components.

6. A method of vocal analysis, the method comprising extracting speech synthesis parameters from an input signal in a method according to claim 1, and comparing the complex cepstral with threshold parameters.

7. A method of training a speech synthesiser, the synthesiser comprising a source filter model for modelling speech using an excitation signal and a synthesis filter, the method comprising training the synthesis parameters by deriving speech synthesis parameters from an input signal using a method according to claim 1, the method further comprising storing the position of the pulses and the complex cepstrum resulting in said minimum difference in a memory as the speech synthesis parameters derived from the input signal.

8. A method according to claim 7, the method further comprising training the synthesiser by receiving input text and speech, the method comprising extracting labels from the input text, and relating derived speech parameters to said labels via probability density functions.

9. A text to speech method, the method comprising:

receiving input text;

extracting labels from said input text;

using said labels to extract speech parameters which have been stored in a memory, generating a speech signal from said extracted speech parameters wherein said speech signal is generated using a source filter model which produces speech using an excitation signal and a synthesis filter, said speech parameters comprising complex cepstrum parameters, wherein said complex cepstrum parameters which are stored in said memory have been derived using the method of claim 1.

10. A text to speech method according to claim 9, wherein said complex cepstrum parameters are stored in said memory as minimum phase cepstrum parameters and phase parameters, the method being configured to produce said excitation signal using said phase parameters and said synthesis filter using said minimum phase cepstrum parameters.

11. A system for extracting speech synthesis parameters from an audio signal, the system comprising a processor adapted to:

receive an input speech audio signal;

estimate a position of glottal closure incidents from said input speech audio signal;

derive a pulsed excitation signal from the position of the glottal closure incidents;

segment said input speech audio signal on the basis of said glottal closure incidents, to obtain segments of said input speech audio signal;

process the segments of the input speech audio signal to obtain a complex cepstrum and deriving a synthesis filter from said complex cepstrum;

produce a reconstructed speech signal by passing the pulsed excitation signal derived from the position of the glottal closure incidents through said synthesis filter derived from said complex cepstrum;

compare said reconstructed speech signal with said input speech audio signal;

calculate a difference between the reconstructed speech signal and the input speech audio signal; and modify the pulsed excitation signal and the complex cepstrum to reduce the difference between the reconstructed speech signal and the input speech audio signal by executing a process comprising, optimizing the position of the pulses in said excitation signal to reduce a mean squared error between the reconstructed speech signal and the input speech audio signal;

recalculating the complex cepstrum by optimizing the complex cepstrum by minimizing the difference between the reconstructed speech signal and the input speech audio signal using the optimized pulse positions; and repeating the process to derive as said speech synthesis parameters the position of the pulses and the complex cepstrum resulting in a minimum difference between the reconstructed speech signal and the input speech audio signal.

12. A text to speech system, the system comprising a memory and a processor adapted to:

receive input text;

extract labels from said input text;

use said labels to extract speech parameters which have been stored in the memory; and generate a speech signal from said extracted speech parameters wherein said speech signal is generated using a source filter model which produces speech using an excitation signal and a synthesis filter, said speech parameters comprising complex cepstrum parameters, wherein said complex cepstrum parameters which are stored in said memory have been derived using the method of claim 1.

13. A non-transitory computer readable medium comprising computer readable code configured to cause a computer to perform the method of claim 1.

14. A non-transitory computer readable medium comprising computer readable code configured to cause a computer to perform the method of claim 9.

* * * * *